US012146332B1

(12) United States Patent
George et al.

(10) Patent No.: US 12,146,332 B1
(45) Date of Patent: Nov. 19, 2024

(54) BASE FOR UTILITY POLE

(71) Applicant: Pelco Products, Inc., Edmond, OK (US)

(72) Inventors: Kennith E. George, Edmond, OK (US); Angela R. Stussi, Edmond, OK (US)

(73) Assignee: Pelco Products, Inc., Edmond, OK (US)

( * ) Notice: Subject to any disclaimer, the term of this patent is extended or adjusted under 35 U.S.C. 154(b) by 223 days.

(21) Appl. No.: 17/707,916

(22) Filed: Mar. 29, 2022

Related U.S. Application Data

(60) Provisional application No. 63/167,483, filed on Mar. 29, 2021.

(51) Int. Cl.
*E04H 12/22* (2006.01)

(52) U.S. Cl.
CPC ..... *E04H 12/2253* (2013.01)

(58) Field of Classification Search
CPC ..... E04H 12/2253; E04H 12/2261; E04H 12/2269; E04H 12/2292; E01F 9/631
See application file for complete search history.

(56) References Cited

U.S. PATENT DOCUMENTS 2,679,911 A * 6/1954 Bhend ..... E04H 12/2269 52/298
3,343,322 A * 9/1967 Lurkis ..... E04H 12/003 52/298
4,200,906 A * 4/1980 Santilli ..... E04H 12/2261 D26/151
5,337,989 A * 8/1994 Apple ..... E04H 12/2269 52/165
9,657,492 B2 * 5/2017 Mansueto ..... E04H 12/2269
9,869,107 B2 * 1/2018 Moberg ..... E04H 12/08
10,588,441 B2 * 3/2020 Gariti ..... A47G 33/12
11,959,295 B2 * 4/2024 Scott ..... E01F 9/677
11,970,871 B2 * 4/2024 Fugallo, III ..... E04C 5/168
2013/0192149 A1 * 8/2013 Roach ..... E01F 13/026 52/165
2017/0022730 A1 * 1/2017 Mansueto ..... E04H 12/2238
2017/0121997 A1 * 5/2017 Moberg ..... E01F 9/631
2019/0029454 A1 * 1/2019 Gariti ..... A47G 33/12
2021/0271787 A1 * 9/2021 Fugallo, III ..... E04G 21/185
2022/0180015 A9 * 6/2022 Fugallo, III ..... E04C 5/168
2022/0243491 A1 * 8/2022 Scott ..... E01F 13/026
2023/0407654 A1 * 12/2023 Fugallo, III ..... E04G 21/3223
2024/0198827 A1 * 6/2024 Vicari ..... B60L 53/31

* cited by examiner

*Primary Examiner* — Rodney Mintz
(74) *Attorney, Agent, or Firm* — DUNLAP CODDING, P.C.

(57) ABSTRACT

A frangible base for a utility pole. The base includes a support structure, such as an inner wall extending downwardly from a collar with a shelf. The shelf receives and supports the bottom edge of the pole and with the collar maintains the utility pole in an upright position. A frictional engagement device, such as a U-bolt, is included to surround the bottom of the pole loosely and adjustably when it is resting on the shelf. In this way, the installer has both hands free to rotate the pole to the proper position and then to tighten the U-bolt to complete the installation. A second engagement device, such as a locking plate assembly, may be positioned on the side of the pole opposite the shelf.

19 Claims, 9 Drawing Sheets

BASE FOR UTILITY POLE

CROSS-REFERENCE TO RELATED APPLICATIONS

This application claims the benefit of U.S. provisional application No. 63/167,483 entitled "Frangible Base for Utility Pole," filed Mar. 29, 2022, the contents of which are incorporated herein by reference.

FIELD OF THE INVENTION

The present invention relates to utility poles generally and more particularly, but without limitation, to bases for utility poles.

BRIEF DESCRIPTION OF THE DRAWINGS

FIG. 8 is an enlarged sectional view of the circular area designated as "B" in

FIG. 7.

FIG. 10 is an enlarged view of the view of the circular area designated as "C" in

FIG. 8.

DETAILED DESCRIPTION OF THE PREFERRED EMBODIMENT(S)

Figure 1:
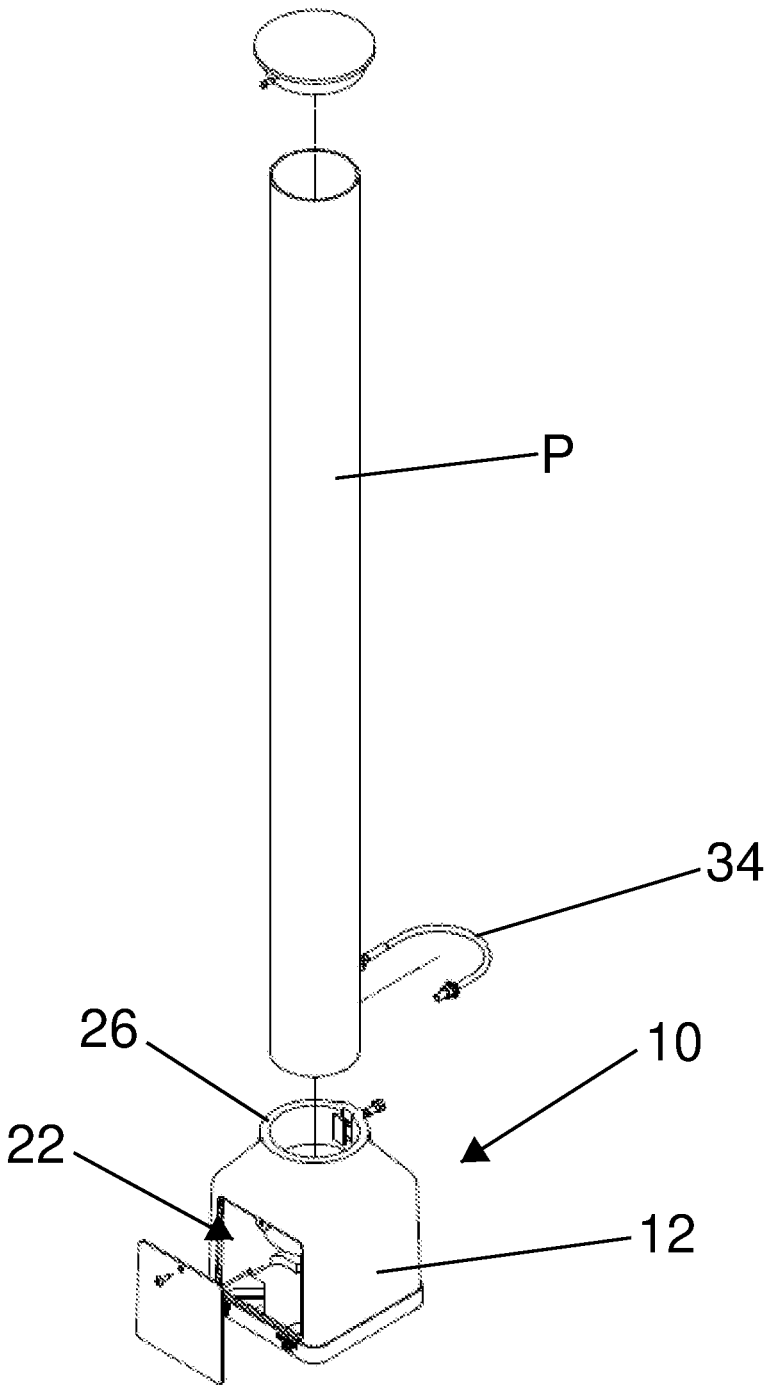
FIG. 1 is an exploded perspective view of a base and utility pole in accordance with an embodiment of the present invention.
Figure 2:
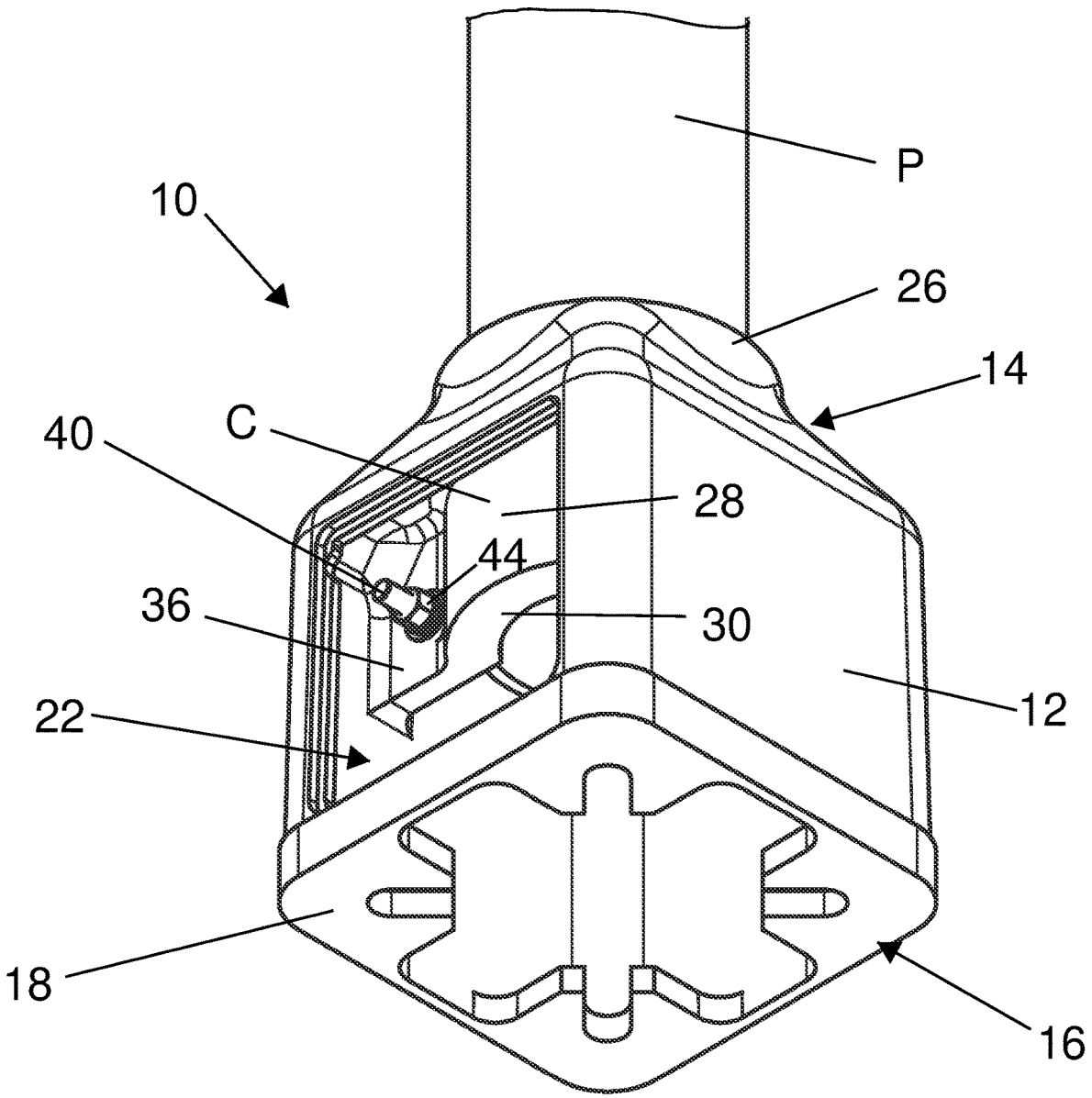
FIG. 2 is a bottom perspective view of a base shown in FIG. 1.
Figure 3:
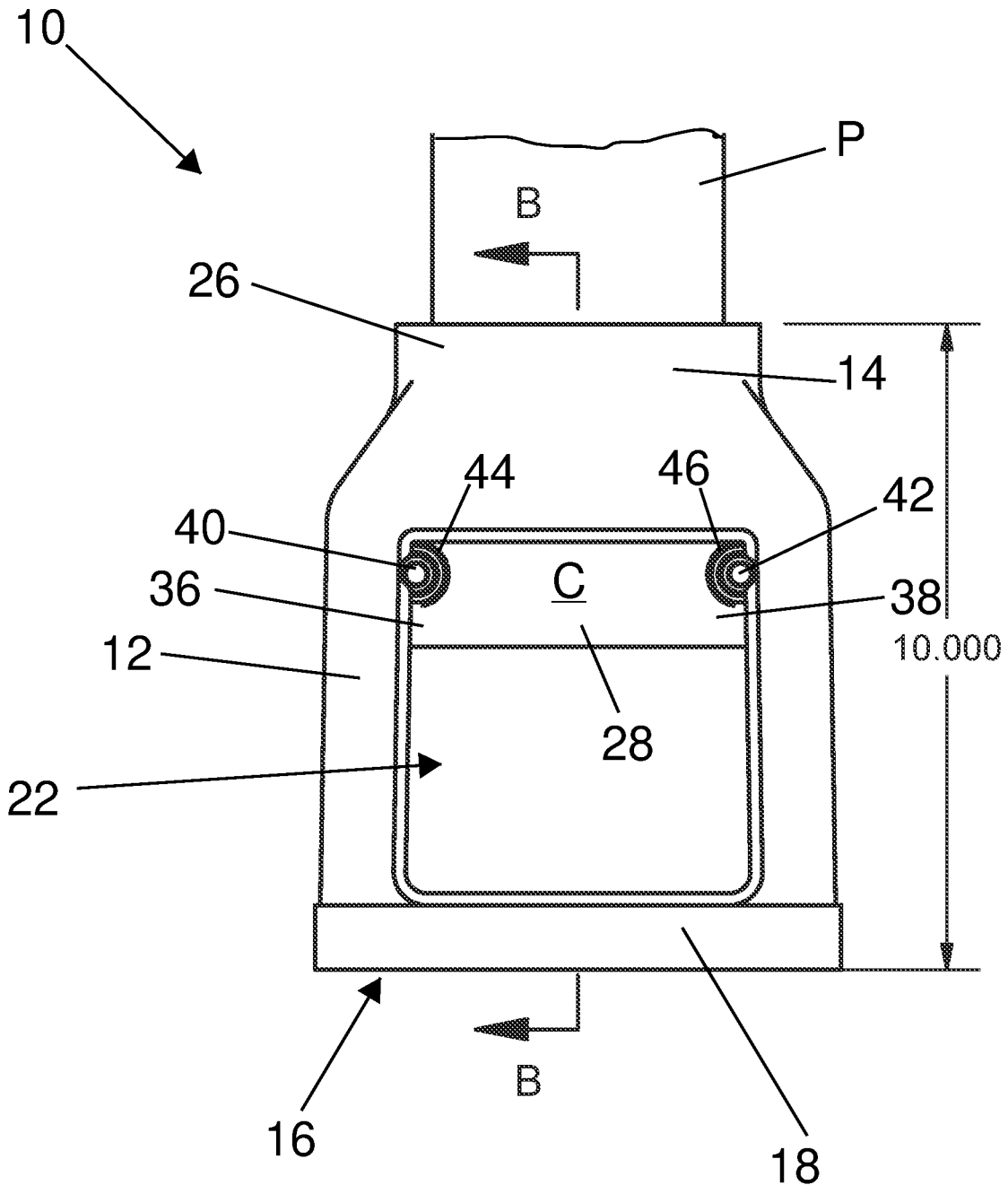
FIG. 3 is a front elevational view of the base shown in FIG. 1.

Certain traffic control devices and other exterior utility devices are mounted on vertical supports such as poles or pipes that are supported in a base that is secured to the ground. As used herein, "utility pole" means a pole, column, post, pipe, or other vertical support member for traffic control devices, including but not limited to pedestrian pushbuttons and other crosswalk control devices, lighting fixtures, electrical and/or fiber optic cables, and the like. For example, a pedestrian push button for controlling the traffic light at an intersection typically is mounted on a standpipe fixed adjacent the walkway.

In some instances, it may be desirable or necessary that the base supporting a utility pole will be frangible. As used herein, "frangible" or "breakaway" means engineered to yield or break upon receiving a lateral impact from a vehicle, for example. This prevents more serious damage to the vehicle and surrounding structures, as well as reducing the likelihood of serious personal injuries to nearby passengers or pedestrians. The present invention provides a base for a utility pole that meets this need as well as providing other advantages.

Turning now to the drawings in general and to FIG. 1-5 in particular, shown therein is a base designated generally by the reference numeral 10. Generally, the device 10 comprises a housing 12 with a top 14 and a bottom 16. The housing 12 forms an enclosure and may have any suitable shape and size, depending on the application. The bottom 16 may comprise an attachment plate 18 used to secure the base 10 in a known manner to an anchor in the ground or other mounting surface (not shown). The housing 12 may or may not be integrally formed. The housing 12 may be made of any suitable material, including but not limited to aluminum, plastic, steel, fiberglass, or other metals, alloys, and solid materials, or a combination of these. Certain dimensions are provided in the drawings; these are illustrative only and not limiting.

Figure 6:
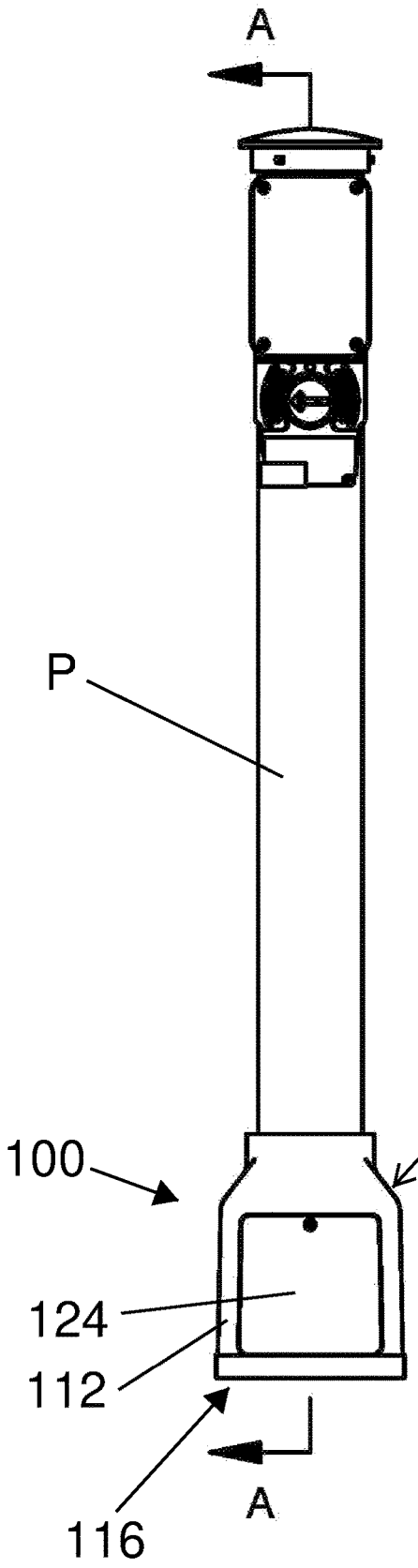
FIG. 6 is a front elevational view of a push button stand in a base in accordance with an embodiment of the present invention.
Figure 7:
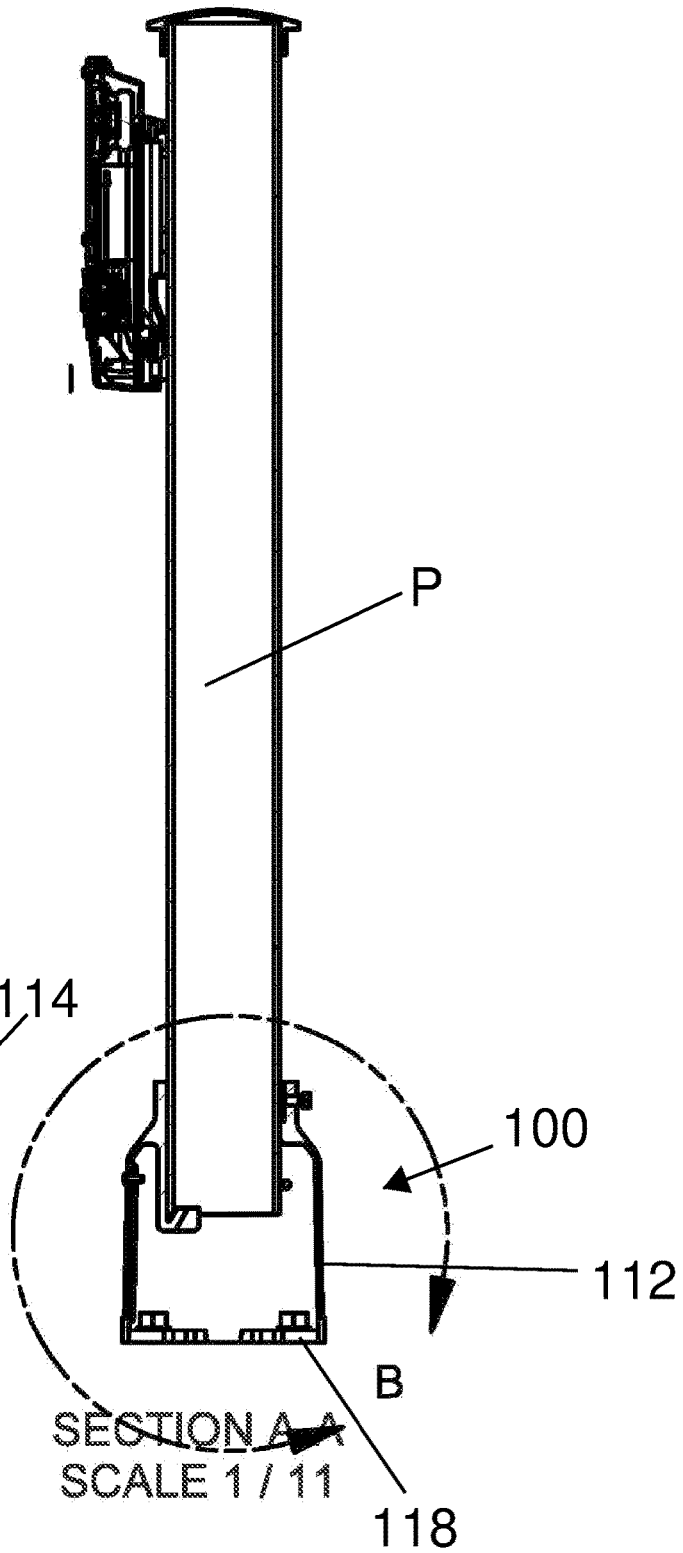
FIG. 7 is a sectional view taken along the line A-A in FIG. 6.
Figure 9:
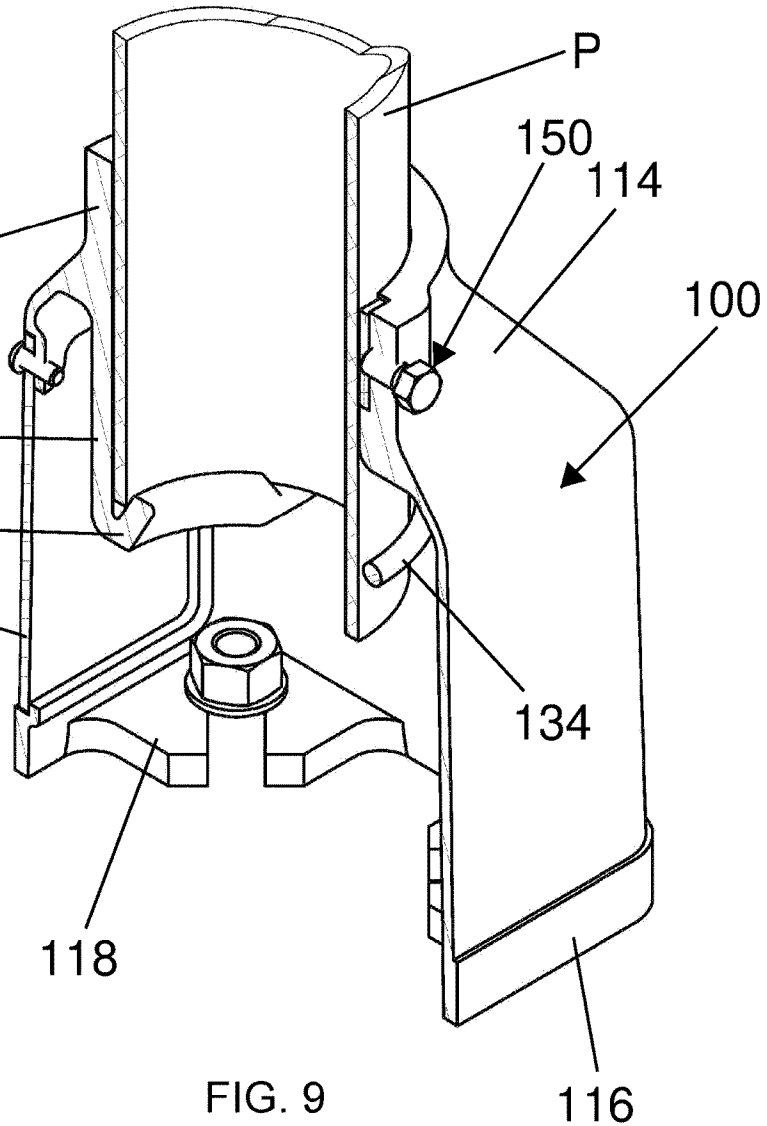
FIG. 9 is an enlarged perspective view of the area shown in FIG. 8.
Figure 8:
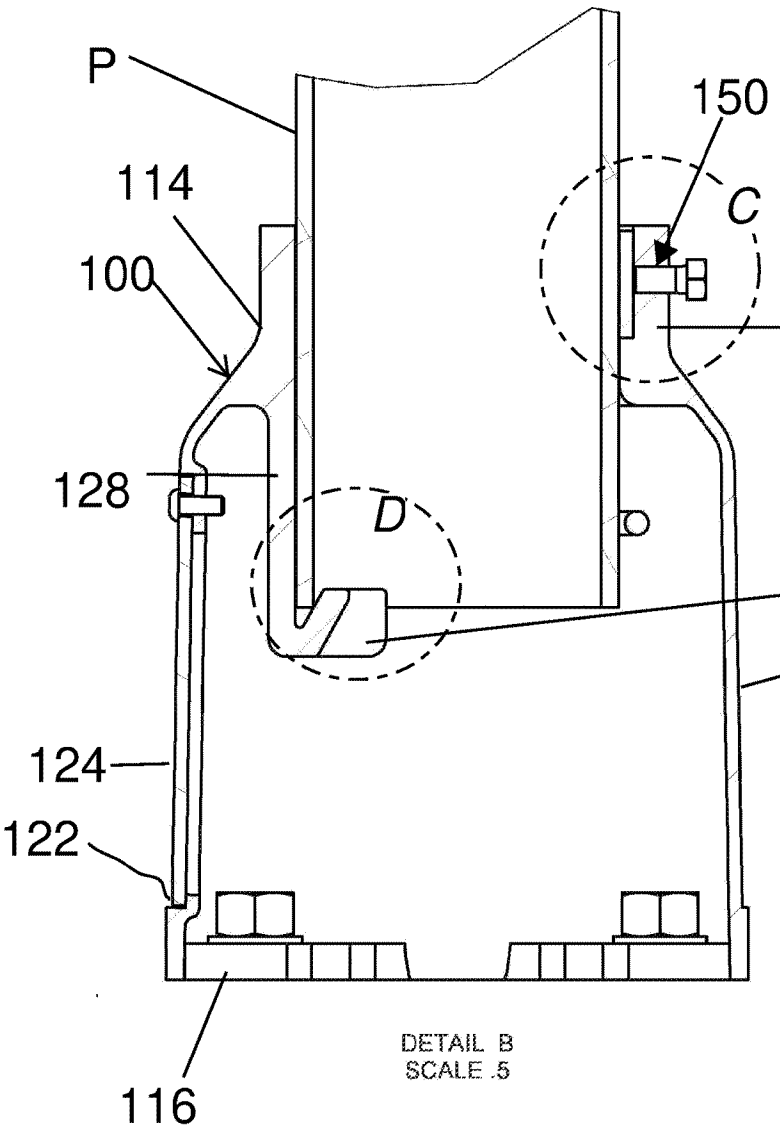
Figure 12:
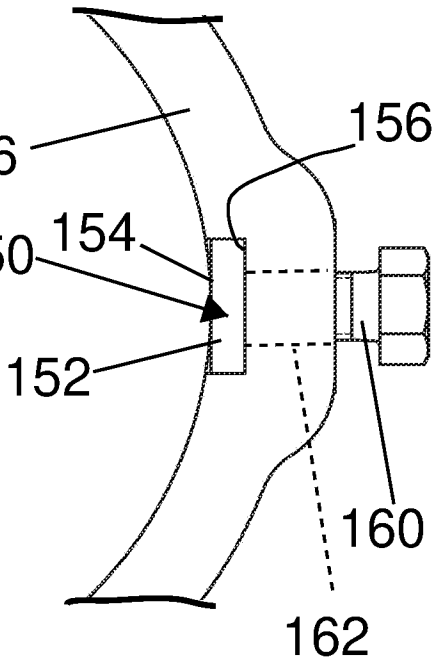
FIG. 12 is a plan view of the area shown in FIG. 10.
Figure 11:
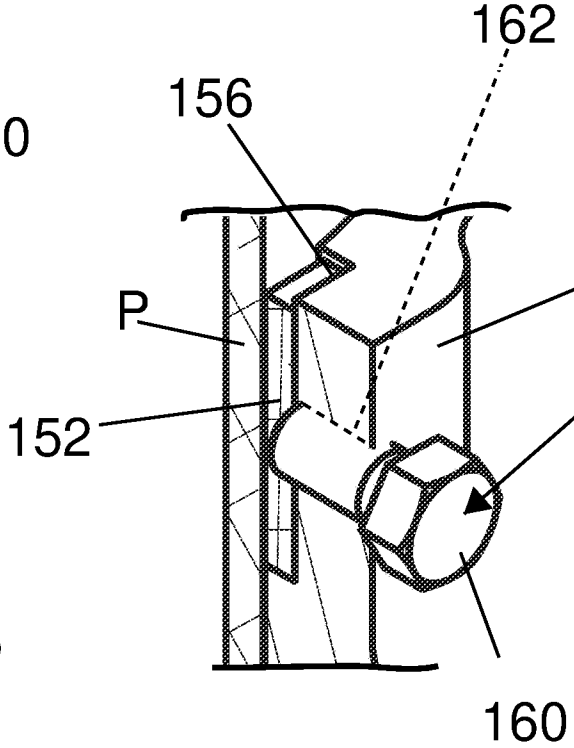
FIG. 11 is a perspective view of the area shown in FIG. 10.
Figure 10:
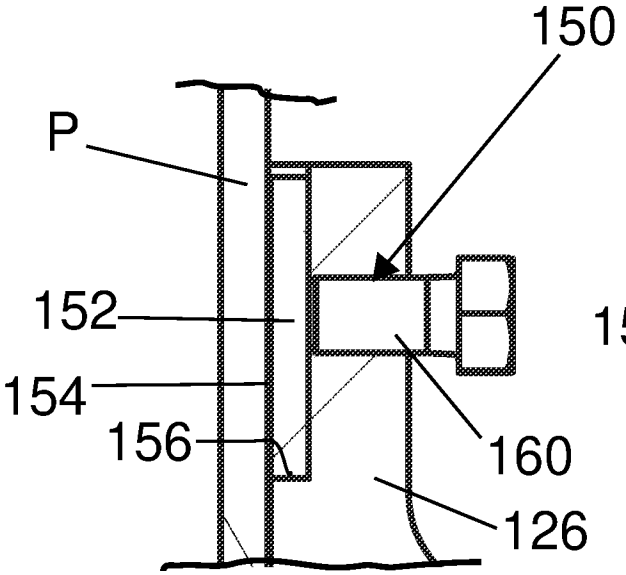

An access opening 22 may be formed in the sidewall of the housing 12. The aspect having the access opening 22 may be designated as the front. A cover or door (see corresponding item 124 in FIG. 6) may be provided to cover the access opening 22. A lock or other mechanism (not shown) may be included in the door to prevent vandalism or unauthorized access to the inside of the housing 12.

Figure 4:
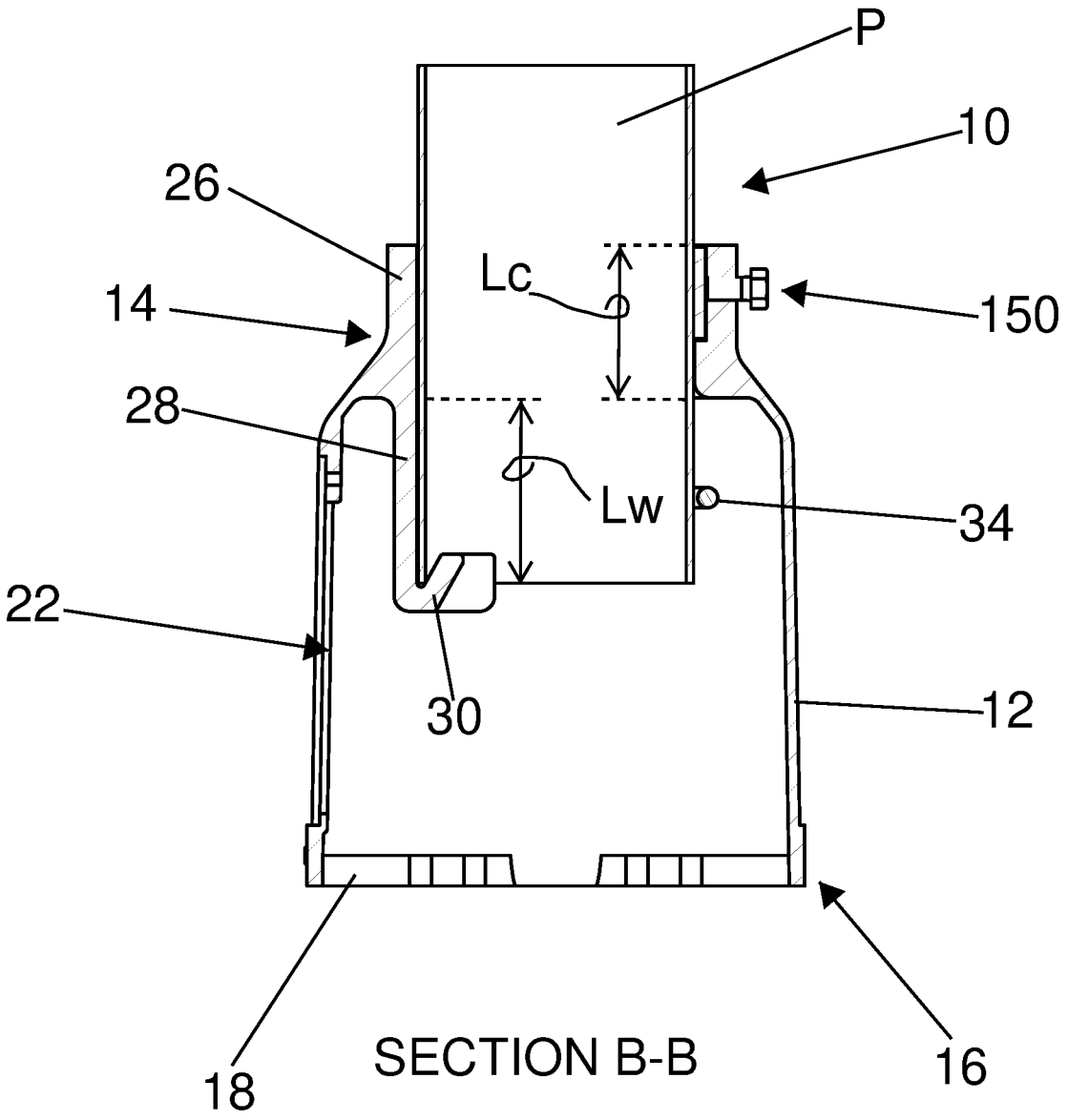
FIG. 4 is a longitudinal sectional view taken along line B-B in FIG. 3.
Figure 5:
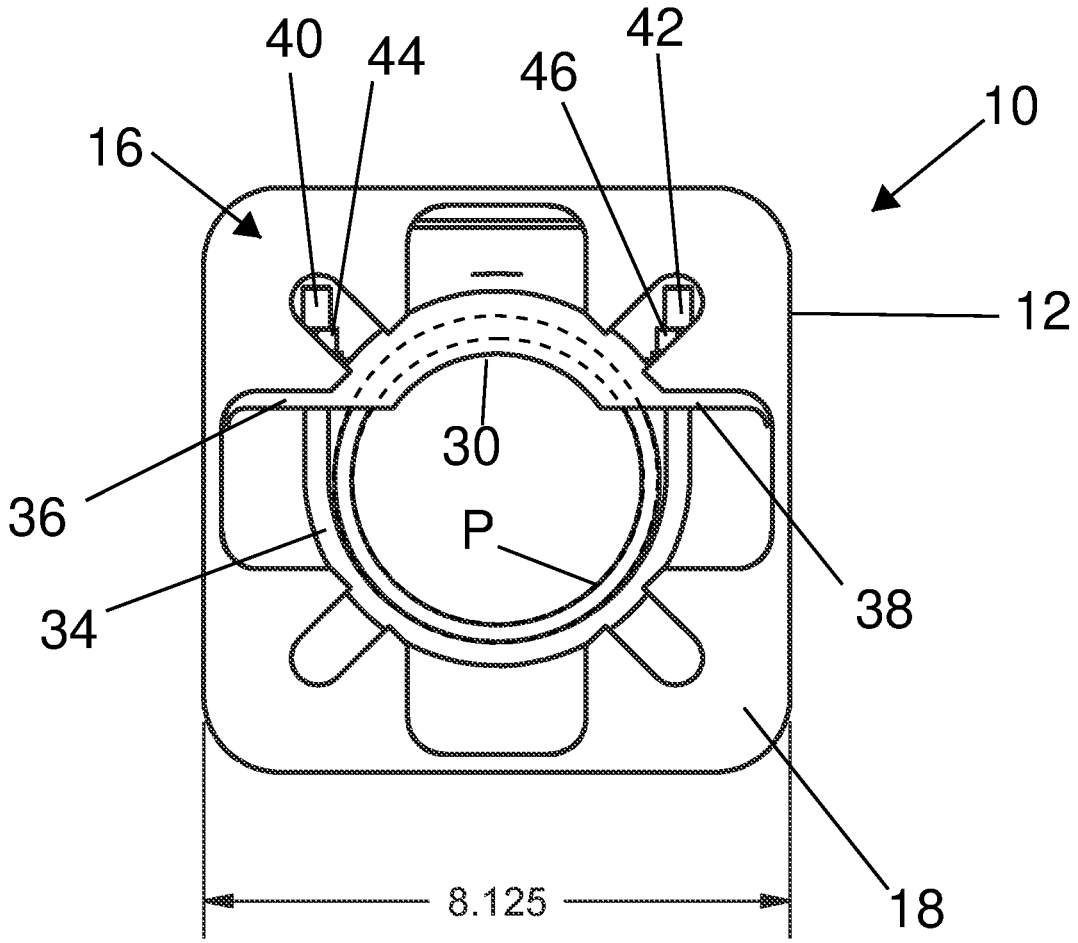
FIG. 5 is a bottom view of the base shown in FIG. 1.

The top 14 of the housing 12 may form a collar 26 configured to receive the bottom end of the utility pole "P". As best seen in FIG. 4, the collar 26 may have a length "$L_C$" (FIG. 4) with an inner diameter sized and configured to slidingly receive the bottom of the post or utility pole P. In many instances, the pole P will be cylindrical in cross section and the inner diameter of the collar 26 with be shaped accordingly. However, other cross-sectional shapes may be used. such as square or hexagonal, by way of example.

Extending downward from the inside bottom of the collar 26 is an inner wall 28 continuous with a least a portion of the inner diameter of the collar and having a length $L_W$. (FIG. 4) A lip or shelf 30 projects inwardly from the bottom of the inner wall 28. The depth of the shelf 30 may vary. In one embodiment, the depth of the shelf 30 is equal to or greater than the thickness of the sidewall of the pole P. Persons skilled in the art will recognize that the shelf may have other suitable configurations consistent with the present invention.

The central portion C of the inner wall 28 may be continuous with the inner diameter of the collar 26 and thus will be configured to conform to the outer diameter of the pole P. In this way, when the pole P is lowered into the base 10, the bottom of the pole will come to rest on the shelf 30. The shelf 30 provides both temporary support while installation is completed and permanent support for pole P.

The base 10 includes a device for frictionally securing the base of the utility pole P once it is properly position on the shelf 30. For example, a strap or belt may be used to surround the pole P and hold it against the inner wall 28. Alternately, one or more set screws could be employed. To that end, the base 10 may include a flange or other anchoring structure extending laterally from one or both sides of the inner wall 28. Although threads may be employed on the base 10 and or the pole P in some embodiments, such threaded engagement is not a requirement of the present invention.

In one embodiment, the securing device is a U-bolt 34 sized to receive the pole P. In this embodiment, illustrated in the FIGS. 1-5, a first flange 36 extends from one side and a second flange 38 extends from the opposite side of the inner wall 28. Thus, the flanges 36 and 38 may include a bolt hole for receiving the ends 40 and 42, respectively, of the U-bolt 34. Of course, nuts 44 and 46 are included to tighten the U-bolt around the pole P once the pole is positioned.

Now that the base 10 has been described, its use will be explained. First the base 10 is attached to the ground in a suitable manner. The U-bolt 34 may be secured loosely in the base 10 before or after the base 10 is attached. Once the base 10 is positioned and secured, the utility pole P is lowered into the collar 26 until the bottom of the pole comes to rest on the shelf 30. Now it will be appreciated that the collar 26, inner wall 28 and shelf 30 may be configured so that the pole P will be loosely supported in the base 10. This allows the installer to have both hands free to rotate the pole P as needed to achieve the correct orientation.

Additionally, because the pole P is supported upright by the loose U-bolt 34 and the shelf 30 and inner wall 28, the installer will have both hands free to tighten the U-bolt 34 or other securing device. It will also be apparent now that from time to time, as needed, the pole P can be rotated to a different orientation by simply loosening the U-bolt 34 without having to remove the pole from the base 10; the pole will remain upright but loose enough to rotate.

FIGS. 6-14 illustrate another embodiment of the utility pole base of the present invention designated generally by the reference number 100. Generally, the device 100 comprises a housing 112 with a top 114 and a bottom 116. The housing 112 forms an enclosure and may have any suitable shape and size, depending on the application. The bottom 116 may comprise an attachment plate 118 used to secure the base 10 in a known manner to an anchor in the ground or other mounting surface (not shown). The housing 12 may or may not be integrally formed. The housing 12 may be made of any suitable material, including but not limited to aluminum, plastic, steel, fiberglass, or other metals, alloys, and solid materials, or a combination of these. Certain dimensions are provided in the drawings; these are illustrative only and not limiting.

As in the previous embodiment, an access opening 122 may be formed in the sidewall of the housing 112. The aspect having the access opening 122 may be designated as the front. A cover or door 124 may be provided to cover the access opening 122. A lock or other mechanism (not shown) may be included in the door to prevent vandalism or unauthorized access to the inside of the housing 112.

The top 114 of the housing 112 may form a collar 126 configured to receive the bottom end of the utility pole "P". As seen in the previous embodiment, the collar 126 may have a length (FIG. 4) with an inner diameter sized and configured to slidingly receive the bottom of the post or utility pole P. In many instances, the pole P will be cylindrical in cross section and the inner diameter of the collar 126 with be shaped accordingly. However, other cross-sectional shapes may be used, such as square or hexagonal, by way of example.

Extending downward from the inside bottom of the collar 126 is an inner wall 128 continuous with a least a portion of the inner diameter of the collar and having a length as in the previous embodiment. (FIG. 4) A lip or shelf 130 projects inwardly from the bottom of the inner wall 128. In this embodiment, the shelf 130 may take the form of a notch or groove G (FIG. 14), for a reason explained below. In this embodiment, the groove G in the shelf 30 is sized to receive the bottom edge of the pole P. Other configurations for shelf 130 will be recognized by those skilled in the art, all of which are within the scope of the present invention. For instance, the shelf 130 may extend upwards from the bottom 16 or laterally from the inner walls of housing 112.

The central portion C of the inner wall 128 may be continuous with the inner diameter of the collar 126 and thus will be configured to conform to the outer diameter of the pole P. In this way, when the pole P is lowered into the base 10, the bottom of the pole will come to rest in the groove of the shelf 130.

The base 110 includes a first engagement device for frictionally securing the base of the utility pole P once it is properly position on the shelf 130. For example, the first engagement device may be a U-bolt 134, as in the previous embodiment.

The inventive base 110 may include a second engagement device positioned to engage the exterior surface of the pole P inside the collar 126 and on the side of the pole P opposite the shelf 130. This second engagement device may comprise a locking plate assembly designated by the reference number 150. One example of such a locking plate assembly 150 is shown in more detail in FIGS. 10-12, to which attention now is directed.

The locking plate assembly 150 may comprises an engagement plate 152, which may be a flat, rectangular member having an exposed face 154 supported to adjustably engage the pole P. The plate 152 may be partially received in a recess 156 formed in the inner wall of the collar 126. Axial adjustment of the plate 150 may be accomplished using a screw or locking bolt 160 received in a threaded bore 162 extending through the wall of the collar 126. Now it will be appreciated that, once the pole P is positioned in the base 10 with the bottom end resting the groove of the shelf 130, the pole can be stabilized by tightening the plate 152 against the side of the pole using the bolt 160.

Figure 14:
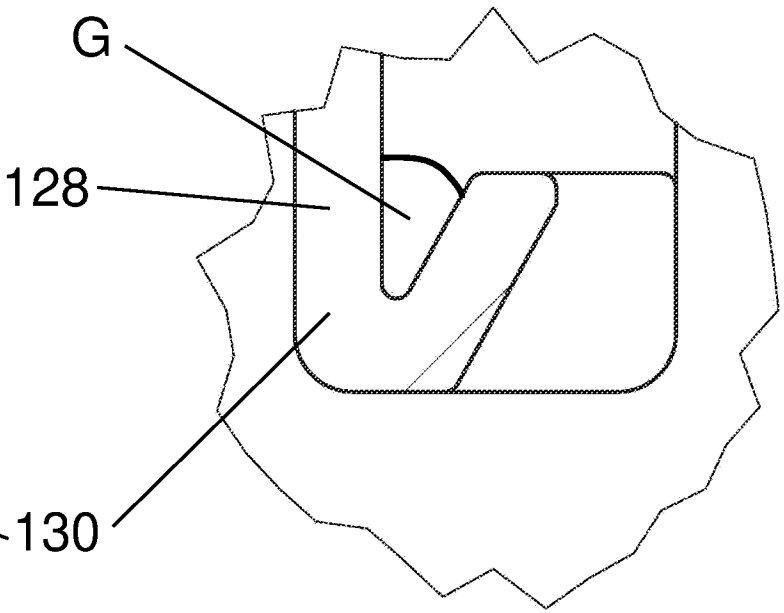
FIG. 14 is a perspective view of the area shown in FIG. 13 illustrating the support groove without the post.
Figure 13:
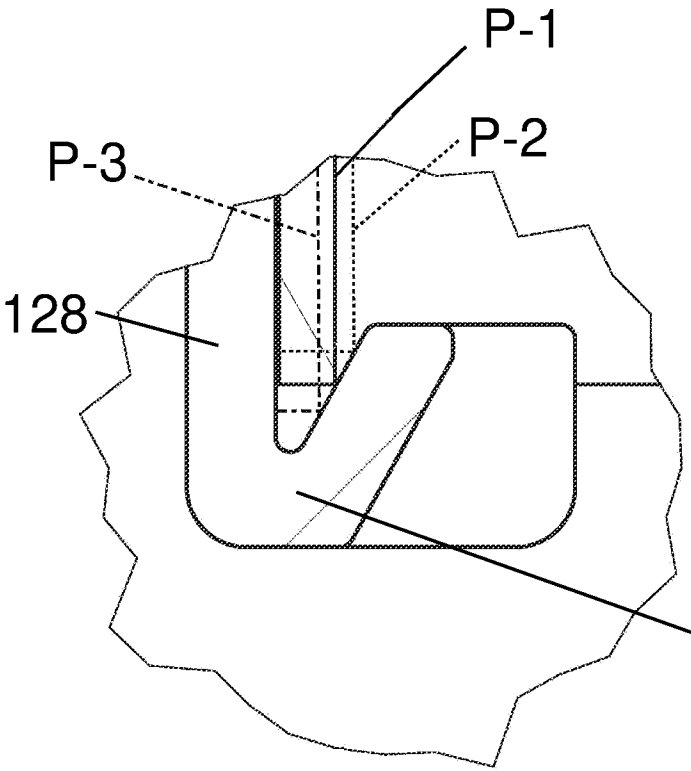
FIG. 13 is an enlarged view of the view of the circular area designated as "D" in FIG. 8 illustrating the position of the bottom edge of the post in three alternative wall thicknesses.

Referring now to FIGS. 13 and 14, preferred features of the shelf 130 will be explained. Poles P come in various wall thicknesses. For example, pole P-I in FIG. 12 has a first wall thickness, and the groove G is sized so that the pole P-I will seat about halfway down in the groove G (FIG. 13). Pole P-2, shown in broken lines, has a second wall thickness that is smaller than the wall thickness of the pole P-1. Thus, P-2 sits slightly higher on the inner surface of the groove G. Pole P-3 has a third wall thickness that is larger than the wall thickness of the pole P-1. Thus, P-3 sits slightly lower or deeper in the groove G. In this way, the inventive base 110 can accommodate multiple wall thicknesses. The angle of the groove G preferably is less than 90 degrees. More preferably, the angle is between about 20 degrees and about 60 degrees, inclusive. In the embodiment shown, the angle is about 30 degrees.

The embodiments shown and described above are exemplary. Many details are often found in the art and, therefore, many such details are neither shown nor described herein. It is not claimed that all of the details, parts, elements, or steps described and shown herein are newly invented. Changes may be made in the details, especially in matters of shape, size, and arrangement of the parts, within the principles of the invention to the full extent indicated by the broad meaning of the terms in the attached claims. The description and drawings of the specific embodiments herein do not point out what an infringement of this patent would be, but rather provide non-limiting examples of how to use and make the invention. Likewise, the abstract is neither intended to define the invention, which is measured by the claims, nor is it intended to be limiting as to the scope of the invention in any way. The limits of the invention and the bounds of the patent protection are measured by and defined in the following claims.

What is claimed is:

1. A base for a utility pole, the base comprising:

a housing having a top end and a bottom end, the bottom end of the housing defining an attachment plate, the top end of the housing defining a collar sized to slidably receive the utility pole;

an inner wall located within the housing, the inner wall having a first end and a second end, the first end extending from an inner surface of the collar towards the bottom end of the housing;

a shelf projecting inwardly from the inner wall, the shelf located above and spaced apart from the bottom end of the housing, the shelf configured to receive and support the utility pole such that the utility pole is rotatable on the shelf; and a first engagement device configured to frictionally secure the utility pole in a selected orientation within the base.

2. The base of claim 1 wherein the first engagement device comprises a U-bolt.

3. The base of claim 1 wherein the base is frangible.

4. The base of claim 1 wherein the inner wall extends along the entire inner surface of the collar and the shelf extends from a portion of the second end of the inner wall.

5. The base of claim 4 wherein the base further comprises a second engagement device configured to adjustably and frictionally engage the utility pole.

6. The base of claim 1 wherein the shelf projects from the inner wall at an angle forming a groove.

7. The base of claim 6 wherein the angle is less than 90 degrees.

8. The base of claim 6 wherein the angle is between about 20 degrees and about 60 degrees, inclusive.

9. The base of claim 6 wherein the angle is about 30 degrees.

10. The base of claim 6 wherein the groove is configured to receive a plurality of different utility pole wall thicknesses.

11. A base for a utility pole, the base comprising:

a housing having a top end and a bottom end, the bottom end defining an attachment plate, the top end defining a collar sized to receive the utility pole, the collar having an outer surface and an inner surface;

an inner wall having a first end and a second end, the first end of the inner wall extending from the inner surface of the collar towards the bottom end of the housing;

a shelf projecting from the inner wall towards a center of the housing, the shelf located above and spaced apart from the bottom end of the housing, the shelf projecting from the inner wall defining a groove configured to receive and support the utility pole, wherein the groove is configured to receive a plurality of different utility pole thicknesses; and a first engagement device configured to secure the utility pole in a selected orientation within the base.

12. The base of claim 11 wherein the base is frangible.

13. The base of claim 11 wherein the housing further comprises a sidewall extending from the top end to the bottom end of the housing, the sidewall having an access opening, with a cover.

14. The base of claim 13 wherein the first engagement device is a U-bolt.

15. The base of claim 14 further comprising a second engagement device positioned to engage the utility pole, wherein the second engagement device is a locking plate assembly.

16. A base for a utility pole, the base comprising:

a housing having a bottom end and a top end, the bottom end defining an attachment plate, the top end defining a collar having an inner surface and an outer surface, the inner surface sized to slidably receive the utility pole;

an inner wall having a first end and a second end, the first end attached to the inner surface of the collar and extending from the inner surface of the collar towards the bottom end of the housing;

a shelf extending from the inner wall, the shelf located above and spaced apart from the bottom end of the housing, the shelf angled relative to the inner wall defining a groove configured to receive and support the utility pole, wherein the groove is configured to receive a plurality of different utility pole wall thicknesses; and a U-bolt located within the housing and configured to secure the utility pole in a selected orientation within the base.

17. The base of claim 16 wherein the shelf extends along a portion of the second end of the inner wall.

18. The base of claim 17 wherein the locking plate assembly engages the utility pole opposite relative to the shelf.

19. The base of claim 18 wherein the locking plate assembly comprises an engagement plate and a locking screw.

* * * * *